United States Patent [19]

Schmodde

[11] Patent Number: 4,616,488

[45] Date of Patent: Oct. 14, 1986

[54] SINGLE OR MULTI-CAM SYSTEM FOR FLAT-BED KNITTING MACHINES

[75] Inventor: Hermann Schmodde, Albstadt, Fed. Rep. of Germany

[73] Assignee: H. Stoll GmbH & Company, Fed. Rep. of Germany

[21] Appl. No.: 784,974

[22] Filed: Oct. 7, 1985

Related U.S. Application Data

[63] Continuation of Ser. No. 644,900, Aug. 28, 1984.

[30] Foreign Application Priority Data

Sep. 21, 1983 [DE] Fed. Rep. of Germany ..... 3334040

[51] Int. Cl.[4] ..... D04B 7/10

[52] U.S. Cl. ..... 66/70; 66/76

[58] Field of Search ..... 66/64, 70, 67, 73, 76, 66/78, 75.2

[56] References Cited

U.S. PATENT DOCUMENTS

| | | | |
|---|---|---|---|
| 3,615,145 | 10/1971 | Goller et al. | 66/78 |
| 3,693,377 | 9/1972 | Hadam | 66/78 |
| 4,012,927 | 3/1977 | Kühnert | 66/78 |
| 4,287,727 | 9/1981 | Otoshi | 66/75.2 |
| 4,474,037 | 10/1984 | Kühnert | 66/64 |
| 4,555,917 | 12/1985 | Kühnert | 66/70 |

*Primary Examiner*—Ronald Feldbaum
*Attorney, Agent, or Firm*—Jones, Tullar, Cooper

[57] ABSTRACT

A single or multi-cam system (11) for flat-bed knitting machines having needle, jack and selector cam units (13, 14 and 16) arranged one beneath the other is described. The needle cam unit (13) features at least one knitting cam and an integrated transfer cam (17, 18) for both carriage traverse and transfer directions. The knitting cam has adjustable, spaced apart, stitch cams (26, 27). The transfer cam has transfer cam parts having a pretensioning higher lobe (48, 49) for pretensioning the loops and a trailing lower lobe (51, 52) for transferring the loops and associated transfer receiving cam parts.

With a multi-cam system (11) for flat-bed knitting machines of this type, the combined, respectively integrated knit and transfer cam (17, 18) is made narrower, without the additional cost or effort associated with mechanical drives and/or switching devices being necessary. For this, the transfer cam parts are formed by the respective stitch cam (26, 27), which features the appropriate pretensioning lobe (48, 49).

The appropriate trailing transfer lobe (51, 52) is partially formed by the stitch cam (26, 27) and partially by a non-switching type transition piece (31, 32) lying next to the stitch cam and bordering the draw down track.

7 Claims, 2 Drawing Figures

SINGLE OR MULTI-CAM SYSTEM FOR FLAT-BED KNITTING MACHINES

This is a continuation of copending application Ser. No. 644,900 filed on Aug. 28, 1984.

TECHNICAL FIELD

The present invention relates to a single or multi-cam system for flat-bed knitting machines having needle, jack and selector units arranged one beneath the other. The needle cam unit features at least one knitting cam and an integrated transfer cam for both carriage traverse and transfer directions, whereby the knitting cam preferably features movable, spaced apart, stitch cams, and the transfer cam features transfer cam parts having a leading, preferably higher lobe for pretensioning the loops/stitches and having a trailing, preferably lower lobe for transferring the loops/stitches and associated transfer receiving cam parts.

BACKGROUND OF THE INVENTION

With single or multi-cam systems of this type for flat-bed knitting machines, as disclosed, for example, in German laid open application No. 31 38 981, the transfer cam parts are provided with a so-called triple lobe cam profile, this means, as well as having the one common transfer lobe, it has two pretensioning lobes of which one preceeds in one direction and the other in the other direction. This means, that the needles in each direction must allow the appropiate trailing pretensioning lobe, which when trailing does not operate, to also pass through. The design of the transfer cam parts in the form of a triple lobe cam requries a relatively wide cam and correspondingly, a relatively wide carriage as well, which results in a certain loss of efficiency and an unnecessary strain on the thread material.

To reduce the cam and carriage width of such types of single or multi-cam systems as this, it is disclosed in German laid open application No. 32 11 515 to equip the transfer cam parts with a so-called twin lobe cam profile only, and to move it in such a manner, that the leading lobe is always the higher pretensioning lobe and the trailing lobe is always the lower transfer lobe. However, one has to tolerate the fact the additional drive and/or switching devices must be provided for moving the transfer cam part in question.

SUMMARY OF THE INVENTION

It is an object of the present invention to provide a single or multi-cam system for flat-bed knitting machines of the aforementioned type, whose combined, respectively integrated knitting and transfer cam can be manufactured even narrower, without the additional cost/effect vis-a-vis mechanical drive and/or switching devices being necessary.

This object is achieved for a single or multi-cam system for flat-bed knitting machines of the type mentioned in that at least one of the transfer cam parts is formed by the respective stitch needle which features the appropriate pretensioning lobe.

Since, in accordance with the present invention, the needle sinker cams or stitch cams on single or multi-cam systems for flat-bed knitting machines are used to assist the formation of the transfer curve, i.e., for the lobe or lobes, the combined, respectively integrated knitting and transfer cam can be made narrower, especially as the stitch cams are provided in any case and retain the dimension of a normal knitting cam by the design in accordance with the present invention. As a result of this short cam construction, losses in efficiency of the machine are avoided. Since only the leading stitch cam is used at any one time of the two stitch cams of a knitting cam, in accordance with the preferred variant of this invention, the needles only have to pass through two lobe systems, in other words, the leading pretensioning lobe and the one trailing transfer lobe; thus avoiding the aforementioned strain on the thread material.

In accordance with a further embodiment of the present invention, the stitch cam does not just feature the pretensioning lobe, but the respective trailing transfer lobe as well, at least in part. It is also possible for the respective trailing transfer lobe to be formed wholely or partially by a non-switching transition piece lying against the stitch cam and demarcating the draw-down cam track. This measure, quite apart from whether this transition piece wholely or partially forms, in association with the stitch cam, the transfer lobe or not, is still designed to make the cam narrower, since a cam is used for this transfer lobe which is always used on conventional cam systems as a needle track during knitting or the forming of a tuck stitch as a demarcation part.

With this type of arrangement where the pretensioning lobes are on the outer sides of both transfer lobes—lying next to each other or opposite each other—it is, according to a further embodiment of the present invention, advantageous to assemble the transfer receiving cam parts into a symmetrical switch-type transfer receiving cam element, at least in part, having a single center transfer lobe. A transfer receiving cam element of this type can be fitted in either the needle cam unit or the jack cam unit. If the symmetrical transfer receiving cam element is fitted in the needle cam unit, then it is advantageous to make it integral and switch operable.

Further details and configurations of the present invention are given in the following description of a preferred embodiments illustrated in the following figures.

DETAILED DESCRIPTION OF THE PREFERRED EMBODIMENTS

Figure 1:
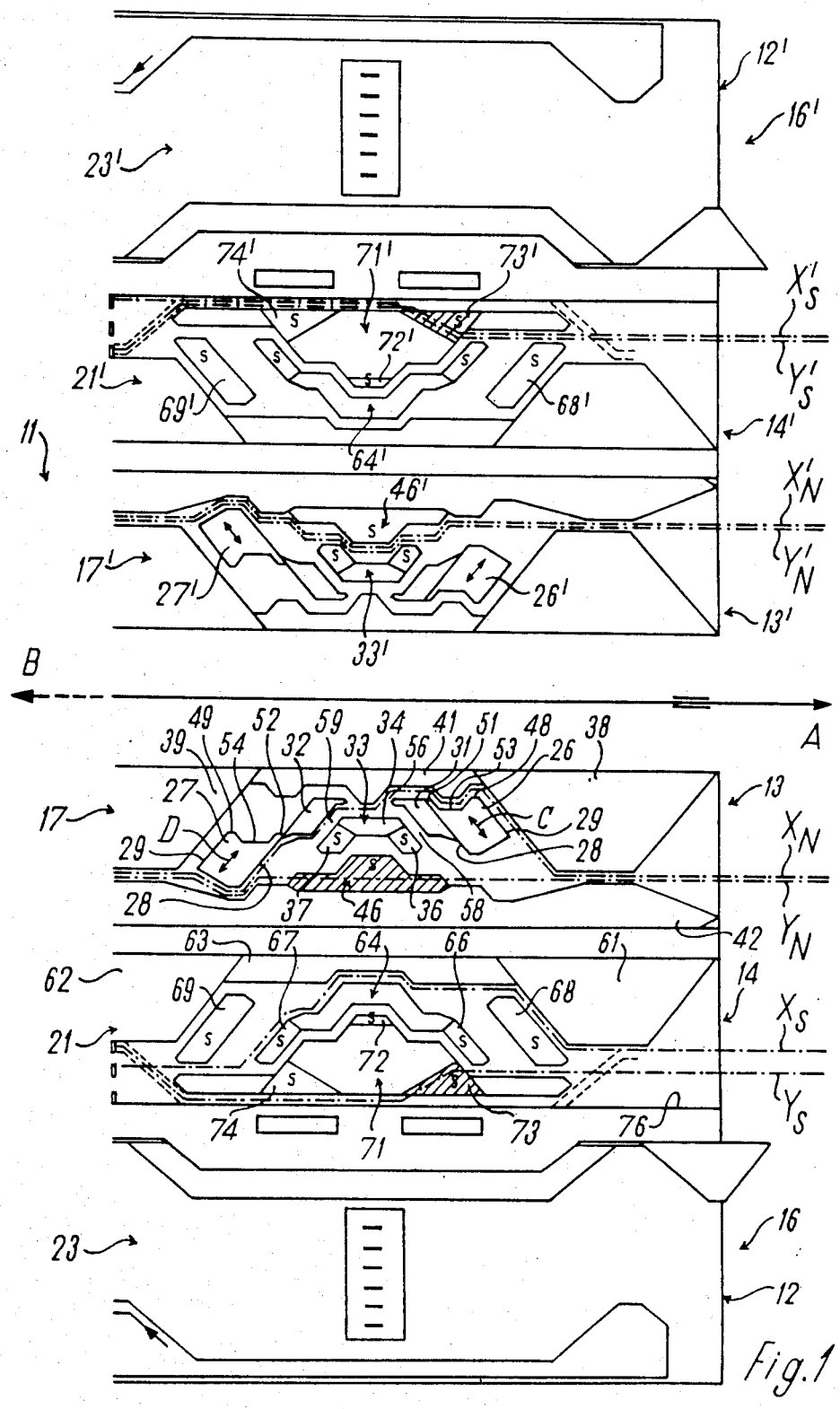
FIG. 1 is a schematic plan view of the right hand part of a double cam system for flat-bed knitting machines in accordance with a preferred example of the present invention.
Figure 2:
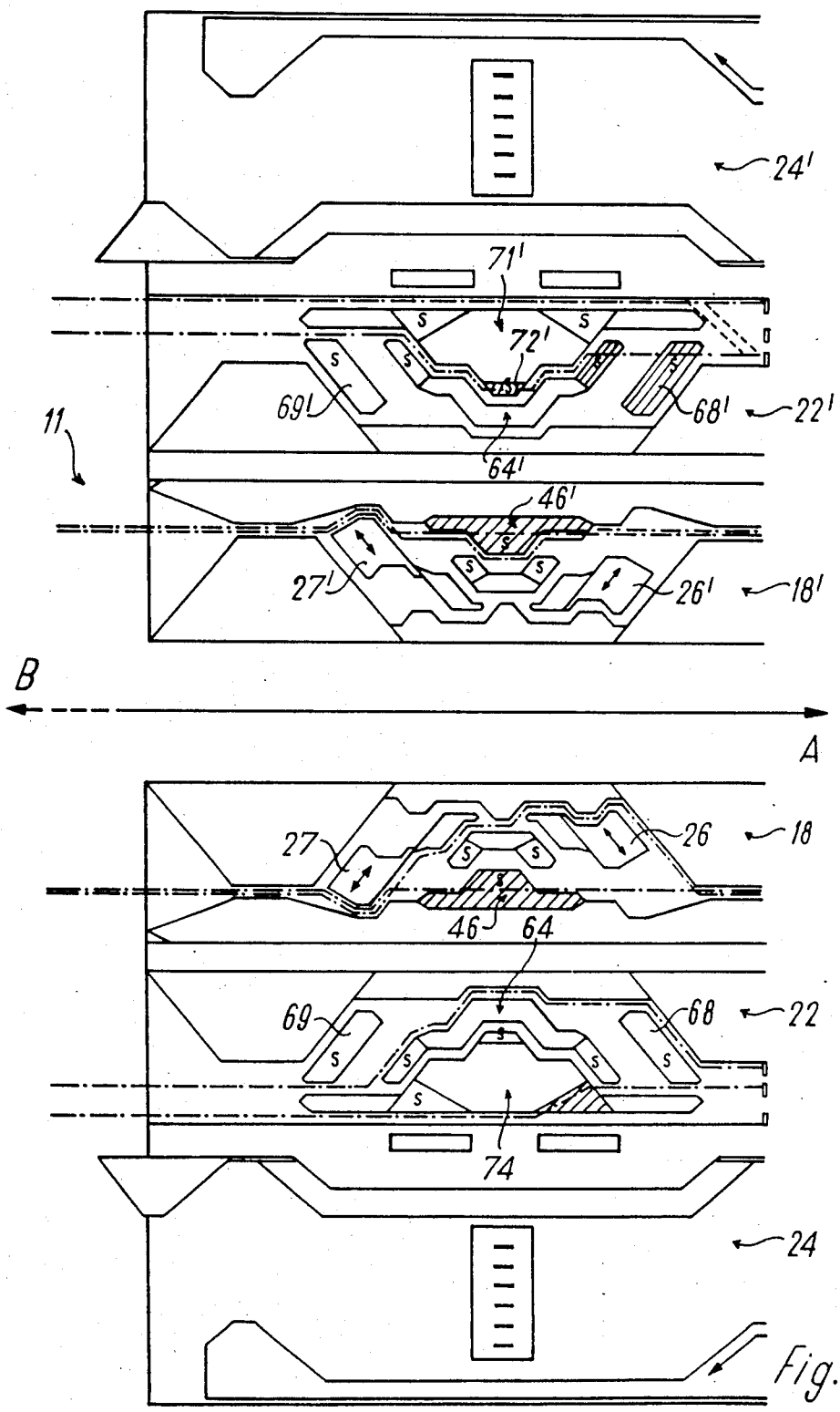
FIG. 2 is a schematic plan view of the left hand part of the double cam system for flat-bed knitting machines according to FIG. 1.

The double cam system 11 illustrated in FIGS. 1 and 2, which can travel along the front and rear needle bed of a knitting machine by a reciprocating rear carriage 12 and 12' respectively, consisting of a front and rear needle cam unit 13 and 13' respectively, a front and rear jack cam unit 14 and 14' respectively, and a front and rear selector cam unit 16 and 16' respectively, which are arranged one beneath the other. Each needle cam unit 13, 13' has two identical combined and/or integrated knit/transfer cams 17, 18 and 17', 18' respectively, arranged one behind the other in the direction of travel A or B due to the double cam system 11; likewise, the jack cam units 14, 14' contains two identical jack cams 21, 22, and 21', 22' respectively, arranged one behind the other; the same applies to the selector cam units 16 and 16', which feature identical selector cams 23, 24 and 23', 24' arranged one behind the other. Before the cams are described in detail, it should be noted that the cam parts marked with "S" are switching types and that the cross-hatched cam parts are switched out of action.

Since the needle cams are manufactured as combined, respectively, intregated knit/transfer cams 17, 18 and 17', 18', these cams are described with the aid of the knit/transfer cam 17 of FIG. 1. Two drawing parts, i.e., stitch cams 26, 27 are provided, spaced apart, for the illustrated, combined, respectively, integrated knit/-transfer cam 17, which can move diagonally towards each other as indicated by the double arrow C and D respectively, for setting the size of the stitch during knitting or the like. A stationary transition piece 31 and 32 respectively, lies against the flanks 28 of the stitch cams 26 and 27 facing each other and between both these transition pieces is fitted a bridging cam 33, whose connecting flank 34 is stationary and whose two diagonal supporting webs 36, 37 can be operated in a switch-like manner. Between the bridging cam 33 and the transition pieces 31, 32 are needle tracks. The flanks 28 facing away from each other of the stitch cams 26, 27, together with stationary trapezoidal cam parts 38 and 39 respectively, demarcate a needle track as well. Between the two trapezoidal cam parts 38, 39 is another stationary cam 41, which is fitted above the stitch cams 26, 27 and the transition pieces 31, 32 and forming a boundary/demarcation with these needle tracks. Beneath the trapezoidal cam parts 38, 39 is fitted a bottom stationary cam 42, which forms with the trapezoidal cam part 38, 39 a feed and/or exit track for the knit/-transfer cam 17. In the center of this bottom cam part 42 is fitted a symmetrical transfer receiving cam part 46, which can be switch operated and which forms a needle track with the bridging cam part 33.

The cam parts described, except possibly the transfer receiving cam part 46, are components of the knitting cam of a needle cam system; they are inclusive of the transfer receiving cam part 46, but are also part of the integrated transfer cam system, in accordance with the present invention. For needle transfer, the stitch cams 26, 27 and the transition pieces 31, 32 are designed as transfer cam parts. The stitch cams 26, 27 have a higher pretensioning lobe 48 and 49 respectively, and a lower transfer lobe 51, 52, between which is a depression 53, 54. The lobes and the depression are on the upper side of the respective stitch cam 26, 27. The transfer lobe 51, 52 continues on the upper side of the neighboring transition piece 31, 32, lying in the same plane, and continues until a descending track section 56 is reached, which runs into the appropriate draw down track 58, 59. The transfer receiving cam part 46 lying beneath these transfer cam parts is constructed symmetrical and fitted so that the first rise in the direction of travel of the carriage runs beneath the depression 53 and 54 respectively, and the second rise beneath the transfer lobe 51, 52. The common transfer receiving lobe is beneath the descending track section 56.

The jack cams 21, 22, 21', 22', since they are identical, are effectively described too, with the aid of the jack cam 21 of FIG. 1, which is arranged beneath the combined knit/transfer cam 17 described above. The jack cam 21 has two laterally fitted stationary cam parts 61, 62 of trapezoidal form as well, between which an upper connecting cam part 63 extends, and beneath which in the center a bridge-like cam part 64 is situated. The cam part 64 is provided with switching end sections 66, 67, whose outer sides face the feeder cam parts, which form a rising inclined feeder track with the trapezoidal cam parts 61 and 62 respectively. Beneath the centrally positioned bridge-like cam part 64 is fitted a transfer receiving cam part 71, whose upper section 72 and whose bottom triangular parts 73, 74 at the sides are of the switching type. The transfer receiving cam part 71 forms a jack track, not just with the bridge-like cam part 64, but also with the bottom edge 76 of the jack cam 21.

The transfer of the loops/stitches from the front needle bed to the rear needle bed and vice versa during the traverse of the carriage will now be described with the aid of FIGS. 1 and 2, whereby the difference between FIGS. 1 and 2 is due to the fact that the cams 17, 21 and 17', 21' respectively, are switched, such that, all the needles of the rear needle bed accept the loops as depicted in FIG. 1, whilst in FIG. 2 the cams 18, 22 and 18', 22' respectively, are switched so that individual needles select the loops via the jacks. The chain dotted lines, one above the other $X_N$, $Y_N$, $X_S$; $Y_S$ and $X'_N$, $Y'_N$, $X'_S$, $Y'_S$ mark the paths of differently selected needles or jacks during the transfer operation from the transferring and accepting of loops from or to the needles. The loops are, therefore, transferred from the front needle bed to the rear needle bed, in so doing, it is evident that this can also occur in exactly the same manner in the reverse sequence for corresponding cam switching. As per FIGS. 1 and 2, the carriage 12, 12' traverses from left to right in the direction of arrow A.

As FIG. 1 depicts, jacks are selected/or not selected in the front carriage 12 by the selector cam 23 for transfer. The selected jacks (line $X_S$) arrive over the leading feeder cam part 68 of the jack cam 21 into the feeder track, such that, the corresponding associated needles, as per line $X_N$ arrive along the rising track between the leading needle sinker cam 26 and the stationary trapezoidal cam part 38. The leading needle sinker 26 is pushed fully upwards, so that it can operate as a transfer cam part. The transferring needles run on, as per the chain dotted line $X_N$ over the leading pretensioning lobe 48, the depression 53 and the leading transfer lobe 51 into the descending track section 56 and are deflected from there into the draw down track 59, which is formed in the top section by the trailing transition piece 32 and the opposite bridge-like cam part 33, and is boardered in the bottom section by the trailing stitch cam 27 with its flank pushed down. Whilst the leading stitch cam 26 serves as a transfer cam part, the trailing stitch cam 27 operates as part of the knitting cam, whereby its pushed-down position determines the stitch size.

As can be seen also in FIG. 1, the non-selected jacks are deflected along the line $Y_S$ into a bottom track away from the transfer cam part 71, due to the leading triangular part 73 being switched out of action, which means, the needles selected not to transfer are driven along the curve $Y_N$ over past the inoperative transfer receiving cam part 46 without transferring.

None of the jack cams are selected in the jack cam system 21 of the rear carriage 12' traversing over the rear needle bed, and as a result, all the needles are brought into the transfer receiving position. The jacks, therefore, are all deflected down (lines $X'_S$ and $Y'_S$) away from the transfer receiving cam part 71', due to the inoperative leading triangular part 73', so that they remain inoperative. In the rear knit/transfer cam system 17', the transfer receiving cam part 46' is switched to operate, which means, that all the needles arrive through the transfer receiving track, which is formed between the transfer receiving part 46 and the opposite bridge-like cam part 33' (sse lines $X'_N$ and $Y'_N$). The drawing down of these needles arriving over the transfer cam 46' is achieved along the trailing zone of the transfer receiving cam part 46' and along the depressed trailing needle sinker cam 27'.

As mentioned, transfer is carried out in the same way in the other cams of FIG. 2 of the double cam system, but transfer is not made by all the needles, but selectively via a selection of appropriate associated jacks. The combined, respectively integrated knit/transfer cam 18, plus the jack cam 22 of the front carriage 18 beneath it, are, therefore, switched in exactly the same manner and the same transfer action is, therefore, achieved in the knit/transfer cam 18 for the respective needles, i.e., transfer operation, as has been described with the aid of the cam 17 of FIG. 1 (see lines $X_N$, $Y_N$ and $X_S$, $Y_S$).

The situation is, however, different for the cams 18' and 22' in the rear carriage 12' of the rear needle bed. There, the cam parts 72' of the transfer receiving cam part 71', the leading end section 66 of the bridge-like cam part 64' and the leading feeder cam part 68' in the jack cam 22' are switched in the inoperative position, which means, that the selected jacks arrive at the transfer receiving cam part 71' and are listed to the transfer receiving lobe (line $Y'_S$). This requires that in the knit/-transfer cam 18' the needles associated to the selected jacks for inoperative transfer receiving cam part 46' are handled as though the transfer receiving cam 46' were switched in its operable state, thus causing a transfer movement (lines $Y'_N$). Since the transfer receiving cam part 46' is inoperable, however, the respective needles, associated to non-selected jacks, can pass over the transfer receiving cam part 46' and away in a straight line, without being subjected to a transfer motion (line $X'_N$). The draw down movement of the jacks and needles is accomplished according to the aforementioned tracks, i.e., as in FIG. 1.

It is evident from the symmetrical layout and/or design of the individual cams and/or cam units, that the transfer process does not just occur in the direction A, but also during the return stroke in direction of the arrow B, and that in the same manner, as transfer takes place from the front to the rear needle beds, so can transfer be carried cut from the rear to the front needle bed.

Everything that affects/effects the knitting using the illustrated double cam system can apply to the so-called three-way technique. For knitting or for a tuck stitch, the leading feeder part 68 or this and the leading end section 66 of the bridge-like cam part 64 in the jack cam is switched in its inoperable position, such that the needles in the needle cam run, during knitting, into the track between the leading stationary transition piece 31 and the bridge-like cam part 33, or during the forming of a tuck stitch run beneath the bridge-like cam part 33, whose two supporting webs 36, 37 are switched out of action. During knitting and during the forming of tuck stitches the respective trailing needle sinker cam is in its normal functional mode, i.e, it is affected by the size of the loop/stitch, whilst the respective leading needle sinker cam takes up its upper position.

What is claimed is:

1. A single or multi-cam system for flat-bed knitting machines having at least a needle cam unit and a selector cam unit arranged one beneath the other, the needle cam unit including at least one integrated knitting/-transfer cam assembly for both carriage traverse and transfer directions, wherein:

(i) the knitting cam portion of said integrated knitting/transfer cam assembly includes spaced apart stitch cams, each having a leading lobe and a trailing lobe, said leading lobe being higher than said trailing lobe for pretensioning the loops/stitches and said trailing lobe serving to transfer the loops/-stitches; and (ii) the transfer cam portion of said integrated knitting/transfer cam assembly includes a transfer receiving cam part associated with the stitch cams and at least one of said stitch cams.

2. The single or multi-cam system as defined in claim 1, wherein:

(iii) the leading cam of said spaced apart stitch cams, viewed in the direction of movement of the cam system, is included as part of the transfer cam portion.

3. The single or multi-cam system as defined in claim 1, wherein:

(iii) at least the trailing transfer lobe of the leading cam of said spaced apart stitch cams, viewed in the direction of movement of the cam system, is included as part of the transfer cam portion.

4. The single or multi-cam system as defined in claim 1, wherein:

(iii) the integrated knitting/transfer cam assembly further includes means defining a draw down track, said means including a non-switching type transition piece situated next to each stitch cam and bordering the draw down track; and (iv) said non-switching type transition pieces serving to at least partially form the trailing transfer lobe of its respective stitch cam.

5. The single or multi-cam system as defined in claim 1, wherein:

(iii) the integrated knitting/transfer cam assembly further includes means defining a feeder track for feeding the leading, pretensioning lobes; and (iv) each stitch cam includes a leading flank bordering said feeder track.and an upper flank, adjoining the leading flank, on which said lobes are formed.

6. The single or multi-cam system as defined in claim 1, wherein:

(iii) the transfer receiving cam part is symmetrically formed and includes a single, centered, transfer receiving lobe.

7. The single or multi-cam system as defined in claim 6, wherein:

(iv) the transfer receiving cam part is constructed as one piece and is switched as a whole.

* * * * *